United States Patent [19]

Littleton

[11] 3,994,221

[45] Nov. 30, 1976

[54] SHEETER FOR USE WITH PRINTING PRESS AND ADDING PROVISION FOR ARRESTING, SQUARING AND DIVERTING OF SHEET

[75] Inventor: F. John Littleton, Effingham, Ill.

[73] Assignee: World Color Press, Inc., Effingham, Ill.

[22] Filed: Oct. 2, 1975

[21] Appl. No.: 618,813

[52] U.S. Cl. ..... 101/227; 271/202

[51] Int. Cl.[2] ..... B41F 13/56

[58] Field of Search ..... 271/182, 202, 69; 101/227, 224

[56] References Cited

UNITED STATES PATENTS

| | | | |
|---|---|---|---|
| 2,261,972 | 11/1941 | Matthews | 271/202 X |
| 3,178,174 | 4/1965 | Schneider | 271/202 X |
| 3,502,321 | 3/1970 | McWhorter | 271/202 X |

*Primary Examiner*—Richard A. Schacher

*Attorney, Agent, or Firm*—Leydig, Voit, Osann, Mayer & Holt, Ltd.

[57] ABSTRACT

A sheeter for feeding sheets in shingled relation to a point of collection including a source of sheets, a first conveyor belt and a second conveyor belt operating at substantially reduced speed so that the sheets are collected thereon in shingled relation. For snubbing the successive sheets so that they are decelerated and uniformly spaced on the second conveyor belt, a snubber is provided in the form of a knock-down roller arm rotating in a vertical plane at the upstream end of the second conveyor belt and so spaced therefrom as to press a sheet into engagement with the second conveyor belt, the arm being driven at a rotary speed which is synchronized with the source, with means being provided for adjusting the phase of the arm with respect to the source so that the arm engages the tail of each successive sheet. In the preferred form of the invention the conveyor belts are separated to form a gap occupied by a diverter, and a high speed nip is provided at the downstream end of the gap so that a sheet traverses the gap and is fed into the nip without changing its speed. For squaring up each sheet passing through the high-speed nip, a pair of squaring and press down rollers are provided at the downstream end of the second conveyor belt with means for adjusting the longitudinal position of the rollers so that they are engaged by the leading edge of the sheet just prior to engagement of the tail of the sheet by the knock-down arm thus insuring precise shingling and freedom from buckling of individual sheets. Infinetely variable cutoff is provided.

8 Claims, 7 Drawing Figures

SHEETER FOR USE WITH PRINTING PRESS AND ADDING PROVISION FOR ARRESTING, SQUARING AND DIVERTING OF SHEET

A persistent problem in the design of printing press equipment is to cut sheets from a printed web at high press speed and to decelerate the sheets uniformly for discharge or collection in a pile. A sheet transported edgewise at press speed has substantial momentum causing it to overtravel when discharged onto a slower moving belt so that means must be provided for abruptly decelerating each sheet to belt speed and for accurately positioning the sheets relative to one another in shingled relation.

A sheet feeding apparatus intended for deceleration of individual sheets is set forth in the prior Wilshin et al. U.S. Pat. No. 3,507,489. In that patent Wilshin et al. disclose a number of cyclically operated decelerating or snubbing devices including, in one of the embodiments, a pair of rollers diametrically arranged for rotation about a shaft. While the bodily wiping of a roller against a sheet, in the same direction as the sheet is moving, has certain advantages, analysis shows that the use of two diametrically arranged rollers is accompanied by a number of serious disadvantages. In the first place, if the shaft which carries the rollers is operated in unison with the knife, or other source of sheets, the second roller obstructs the leading end of the following sheet preventing it from moving into shingled relation. Even if the shaft which carries the rollers operates at a rotary speed which is one-half of the knife speed the inactive one of the rollers tends to get in the way, and under-roller clearance is substantially reduced. More importantly, it has been found that an arm with an attached roller acting upon a sheet, while capable of decelerating it, is not capable of positioning each decelerated sheet uniformly and accurately with respect to adjacent sheets so that discharge is non-uniform resulting in an uneven pile at point of discharge. This is particularly true where the conveyor belts are each in the form of a series of separate ribbons laterally spaced from one another.

It is, accordingly, an object of the present invention to provide a sheeter having an improved decelerating arrangement which utilizes an unitary rotary arm which is rotated in synchronism with the source of sheets and which is adjustable in phase so as to engage the tail end of each of a succession of sheets to press the sheet into engagement with a slow moving conveyor belt, and in which the conveyor belt has a conveyance path of at least a full sheet length with means at the downstream end for squaring and positioning the leading edge so that all the sheets are in evenly and accurately shingled relation for discharge onto a stack or pile. It is a related object to provide a sheeter capable of accurate positioning of sheets even though the belt on which the sheets are positioned is formed of a plurality of separate ribbons subject to localized variations in velocity.

It is another object of the present invention to provide a sheeter which not only decelerates a succession of sheets preparatory to discharge but which includes provision for diverting or ejecting a specimen sheet at high speed for inspection purposes. More specifically it is an object of the present invention to provide a sheeter in which a gap is formed between the high speed conveyor belt and the slow speed conveyor belt, with a diverter mechanisms in the gap but in which means are provided for insuring passage of a sheet across the gap at high-speed and with a snubbing mechanism for acting upon the tail of each sheet immediately after it crosses the gap.

It is yet another object of the present invention to provide a sheeter which is capable of keeping a series of decelerated sheets under control for discharge into a stationary collector and which is capable of operation at extremely high input speeds, with a large speed reduction ratio between successive conveyor belts.

It is an object of the invention, generally stated to provide a sheeter capable of discharging sheets accurately positioned, at a speed which is a small fraction of web speed but which is economical in construction and operation, which is easy to adjust and which is free of maintenance problems.

Other objects and advantages of the invention will become apparent upon reading the attached detailed description and upon reference to the drawings in which.

Figure 2:
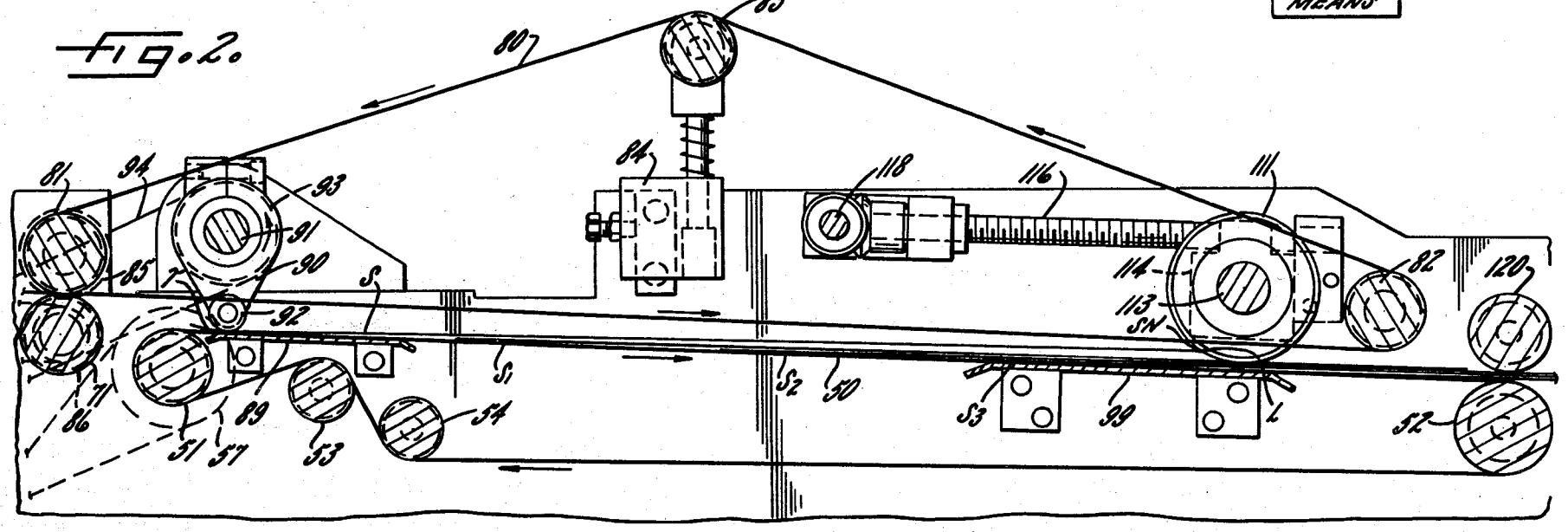
FIG. 2 is an enlarged vertical section showing the slow speed conveyor portion of the assembly shown in FIG. 1.
Figures 2A, 4A:
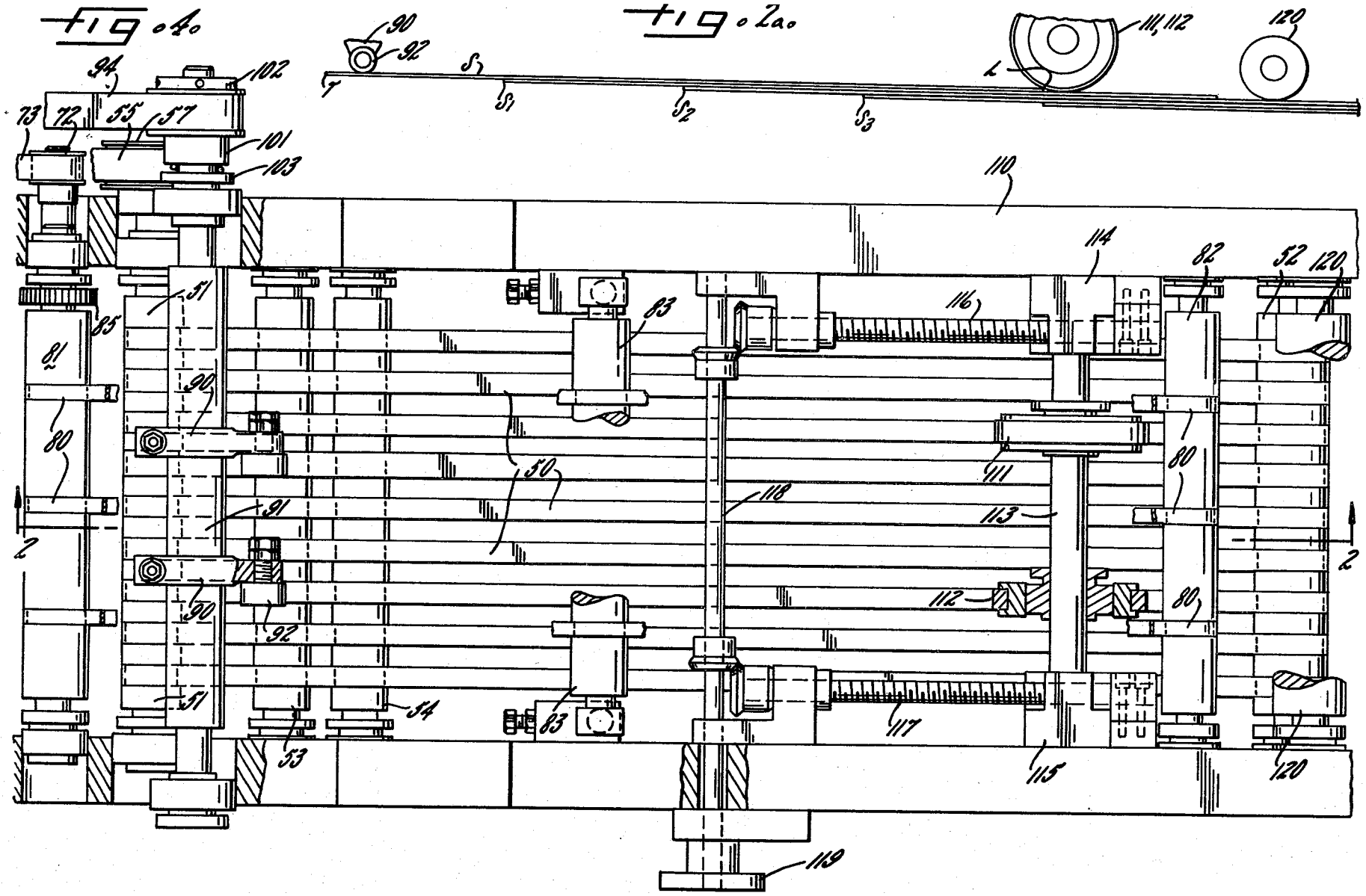

FIG. 2*a* is a diagram based on FIG. 2 for more accurately showing the shingling.

Figure 1:
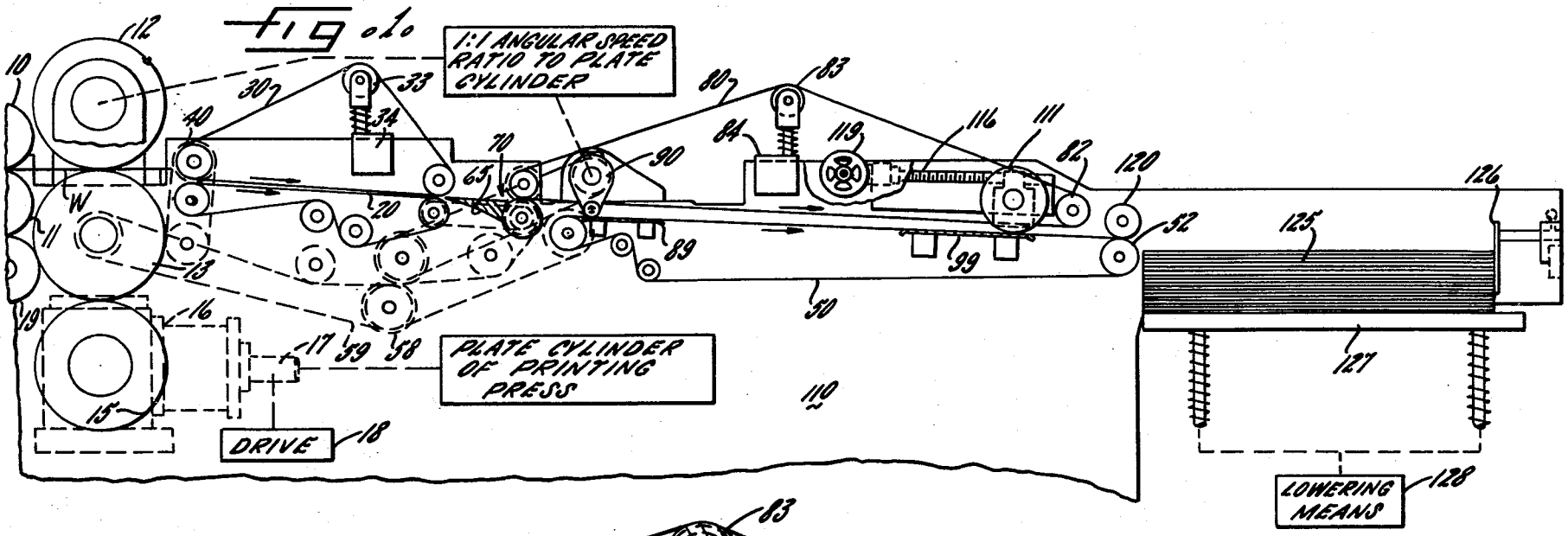
FIG. 1 is a general side elevation, partially diagrammatic, of a sheeter constructed in accordance with the present invention.
Figures 3, 5, 6:
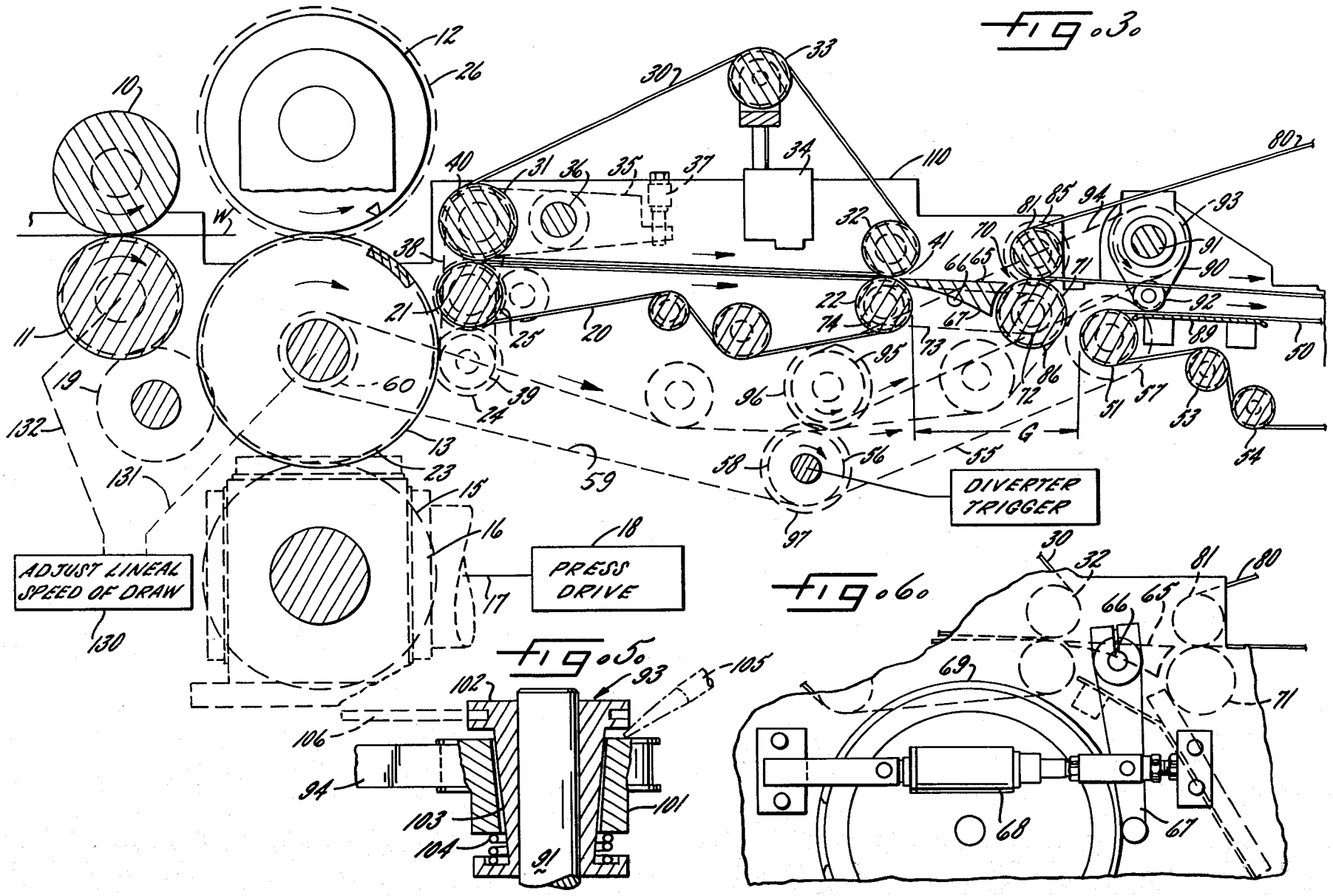

FIG. 3 is an enlarged vertical section showing the high-speed conveyor portion of FIG. 1.

FIG. 4 is a top view of FIG. 2 looking along the line 4—4 therein and with the upper run of the upper belt removed to improve visibility.

FIG. 5 is a cross section showing the taper lock pulley of FIG. 4 being adjusted in phase.

FIG. 6 shows the means for operating the diverter timed with arrival of a sheet.

While the invention has been described in connection with a preferred embodiment, it will be understood that we do not intend to be limited to the particular embodiment shown but intend, on the contrary, to cover the various alternative and equivalent forms of the invention included within the spirit and scope of the appended claims.

Turning now to the drawings there is disclosed a sheeter including a pair of draw rollers 10, 11 and a pair of cutting cylinders 12, 13 acting upon a web of paper 14. The lower one of the cutting cylinders is driven by a gear 15 driven by a gear box 16 having a connection 17 to the press drive generally indicated at 18. The draw rollers are driven from the lower cutting cylinder by a gear 19. The web W, after it passes between the cutting cylinders, but before the sheet is severed, is fed into a high-speed conveyor belt 20 which is trained about rollers 21, 22, the conveyor belt consisting of a plurality of narrow belts or ribbons. For the purpose of driving the high-speed conveyor belt 20 a gear 23 on the cutter cylinder 13 meshes with a gear 24 which drives a gear 25 at the end of roller 21. The upper cutting cylinder has a gear 26.

For the purpose of confining the sheets which are fed seriatim the high-speed conveyor belt 20, a hold-down is provided in the form of an upper belt 30, also comprised of narrow spaced ribbons, and which is trained about rollers 31, 32 33, the roller 33 having an extensible mount 34 for take-up purposes. The entryway between the two belts 20, 30 is adjustable by mounting roller 31 on a rocker arm 35 which rocks about a transversely extending shaft 36, the rocker arm being fixed in position by an adjustable link 37. The upper loop of belt 30 is driven by a belt 38 trained about pulleys 39, 40, the pulley 39 being integral with the gear 24. The driving ratio is such that the two loops of belt 20, 30 are driven at the same lineal speed so that they cooperate in transporting a sheet to a point 41 of high-speed discharge.

Spaced from the discharge end of the high-speed conveyor belt 20 is slow speed conveyor belt 50 in the form of narrow, laterally spaced ribbons, as shown in FIG. 4. The belt 50 is trained about a drive roller 51 at one end and an idler roller 52 at the other, with take-up rollers 53, 54 in between.

For driving the conveyor belt 50 at a relatively slow speed a driving connection is provided which includes a belt 55 trained about a pair of pulleys 56, 57. Connected coaxially to the pulley 56 is a second pulley 58 driven by a belt 59 which is powered from a pulley 60, concentric with, and driven by, the gear 23 on the lower cutter cylinder. The driving ratio is such that the second conveyor belt 50 operates at a speed which is substantially less than the first coneyor belt 20 and which may, in a practical case, be one quarter of the speed of the first belt.

In accordance with one of the aspects of the present invention the two conveyor belts are separated by a gap G (FIG. 3) which is occupied by a diverter to permit diversion of the sheet at high speed for inspection purposes, without interrupting the normal feeding of sheets. The diverter, indicated at 65 (see also FIG. 6) is mounted upon a shaft 66 having an actuating arm 67 operated by a solenoid 68. Thus a sheet ejected from the belt 20 at high speed engages the underside 67 of the diverter for discharge of the sheet in the downward direction. A timing cam 69 serves to delay the opening movement of the diverter until just prior to arrival of the leading edge of a sheet.

In accordance with one of the further aspects of the present invention a high speed nip is located on the downstream side of the gap G for the capture of a sheet fed from the conveyor 20 at high speed so that no change in the speed of the sheet occurs over the region of the gap and to keep the sheet under perfect control just prior to feeding it to the slow speed conveyor belt 50. In the present instance the high speed nip, indicated at 70, is formed by a roller 71 and an upper high speed loop of belt which is spaced above the slow speed conveyor belt 50. The roller 71 is driven by a pulley 72 having a drive belt 73 driven by a pulley 74, the latter being mounted upon the roller 22 which supports the outlet end of the high-speed conveyor belt 20.

Thus, cooperating with the roller 71 is an upper high speed loop of belt 80 which is trained about a roller 81 at the upstream side, a roller 82 at the downstream side, and an idler roller 83, the latter being equipped with take-up means 84. The roller 81 at the upstream side is driven by a gear 85 which meshes with a gear 86 on the roller 71. The drive ratio is such that the upper loop of belt 80, and the roller 71 which cooperates with it, form a high speed nip operating at a lineal speed which is equal to the lineal speed of the high speed conveyor belt 20 so that a sheet which is discharged from the high speed conveyor belt across the gap is immediately accepted, without change in velocity, at the nip 70, with the sheet, passing through the nip, being discharged above the slow speed conveyor belt 50. The higher speed auxiliary loop of belt 80 lies substantially in the plane of high speed discharge, and, because of its speed, acts to induce the prompt flow of sheets to the region above the slow speed belt. In order to prevent the slow speed belt, and the sheets previously deposited upon it, from interfering with the fast induction, the slow speed belt is offset downwardly, as shown, to a slightly lower level. It will be noted that the auxiliary loop of belt 80, in providing the high speed nip 70, extends upstream of the end of the slow speed conveyor belt thereby to accomodate the nip roller 71.

In accordance with the present invention there is provided at the upstream end of the slow speed conveyor belt 50 a knock-down arm 90, the arm being mounted, in duplicate, on a transversely extending shaft 91. Pinned at the end of the arm 90 is a freely turning roller 92, and the shaft 91 is so spaced from the slow speed conveyor belt 50 that the sheet passing through the nip 87 at high speed is pressed against the surface of the slow speed belt so that it is immediately decelerated, acquiring the speed of the belt.

For the purpose of driving the shaft 91 a pulley 93 is mounted upon the end of the shaft (see FIG. 4), about which is trained a belt 94 which is driven by a pulley 95. The pulley 95 is rotated by a gear 96 which meshes with a gear 97 which is coaxial with, and connected to, the pulley 58. The latter is driven, via means previously discussed, from the cutting cylinders. In carrying out the invention the drive ratio between the cutting cylinders and the knock-down arm 90 is 1:1; that is, the knock-down arm 90 rotates once for each rotation of the cutting cylinders and thus acts once upon each sheet being fed through the machine.

For supporting the belt 50 in the region of engagement of the knock-down arm, a supporting plate 98 may be mounted (FIG. 2) under the belt. A second supporting plate 99 is provided adjacent the discharge end.

Means are provided for phasing the knock-down arm 90 so that it operates upon the tail end of each sheet being fed onto the slow speed conveyor belt 50. For the purpose of adjusting the phase of the knock-down arm, the pulley 93 which drives it, and which is shown in FIG. 5, is in the form of a "taper lock" pulley having an outer portion 101 driven by belt 94 and an inner portion 102 which is connected to the shaft 91 upon which the arm 90 is mounted. The portions have uniformly shallow tapering surfaces 103. A clamping spring 104 is interposed between the portions 101, 102 for normally urging them together. The spring 104 is, however, releasable by suitable prying means 105 so that the inner and outer elements of the pulley may be shifted in phase with respect to one another by a turning tool 106.

In accordance with one of the important features of the present invention, the slow speed conveyor 50 not only exceeds the length of the sheet, but there is provided, adjacent its downstream end, an adjustable squaring and press down assembly 110 consisting of a pair of laterally spaced rollers 111, 112 mounted upon a shaft 113 journalled in bearing blocks 114, 115. The bearing blocks are longitudinally movable and positioned by adjusting screws 116, 117 which are simultaneously rotated by an adjusting shaft 118 having a handwheel 119.

The squaring rollers 111, 112, acting as non-driven idler rollers, bear against the slow speed conveyor belt 50, and, with the belt 50, define a squaring nip, indicated at SN in FIG. 2. The nip serves to engage the leading edge L of a sheet S, squaring it up with respect to the direction of movement of the slow speed conveyor, at the same time, or just shortly before, the knock-down arm 90 engages the tail of the tail T of the sheet. The position of the sheet S at the time of squaring and deceleration is illustrated in FIG. 2*a*.

Not only is the knock-down arm 90 phased to engage the tail of the sheet to decelerate it promptly to the speed of the slow speed belt, but the squaring rollers 111, 112 are, by means of the handwheel 119, precisely adjustable so that, immediately prior to such deceleration, the leading edge of the sheet is engaged in the nip SN. This ensures that each sheet will be precisely "square" with respect to the direction of movement of the conveyor and, moreover, that each sheet will be accurately and evenly spaced for uniform discharge from the conveyor. It is to be noted that the squaring and accurate spacing is independent of minor and unpredictable speed variations which may exist between the individual ribbons which form the slow speed conveyor and which may result from localized slippage due to elongation of individual ribbons and changing of the coefficient of friction at the driving surfaces due to aging effects. It will be noted that, by reason of the lower level of the slow speed conveyor belt, the sheet S passes with adequate clearance over the overlapped tails of the immediately preceding sheets S1, S2 and S3.

The rollers 111, 112 not only perform a squaring function but serve as press-down rollers to hold the shingled sheets flatly against the conveyor belt for discharge. From the rollers 111, 112, the shingled sheets pass into the nip of a discharge roller 120 which bears against the conveyor belt 50 opposite its right-hand supporting roller 52.

The sheets which are discharged in shingled relation and at relatively low speed are deposited upon a pile 125 defined by a vertical guide member 126. The accumulated pile is supported upon a platform 127 controlled by automatic lowering means which, since it does not form a part of the present invention, is shown only diagrammatically.

The sheeter mechanism described above is operated in a coordinated fashion with respect to the plate cylinder of the associated printing press. Thus, as illustrated in FIG. 1, the drive 18 is utilized both for driving the sheeter mechanism and the cylinders of the printing press from which the web W is received. Since the common drive synchronizes the sheeter and printing press, the draw rollers 10, 11 will be understood to have the same peripheral or lineal speed as the web, the cutting cylinders 12, 13, will be understood to have a 1:1 angular speed ratio with respect to the plate cylinders (with the cutters thereon phased with the margins between printed areas), and the knock-down arm 90 will also be understood to have a 1:1 angular speed ratio with respect to the plate cylinders and phased, as previously noted, to engage the tails of the successive sheets.

It is one of the features of the present invention that the sheeter is not limited to use with a particular size of sheet but is capable of accommodating sheets of different size printed by different diameters of plate cylinder. Under reference conditions a sheeter may be considered as receiving a web W at a speed of 1200 feet per minute and with printed areas thereon at cyclic intervals of 25 inches requiring cutting of the sheets, with the cut centered in the marginal regions, to produce a sheet length of 25 inches. The speed of the cutting cylinders and the high-speed conveyor 20 is so designed that when the web is at reference speed and reference page length, the sheets are severed and transported with very little spacing between them.

However conditions in the press may depart from this, that is, different diameters of plate cylinders may be employed corresponding to sheet lengths shorter than 25 inches and which may, for example, range over 4 different standard lengths down to, say, a minimum length of 22½ inches.

If the rotational speed of the drive 18 is maintained the same, the use of smaller diameter plate cylinders will result in a correspondingly reduced web speed. To compensate for this, provision is made in the sheeter for changing the diameter of the draw rollers 10, 11, without changing the speed of the drive ratio thereof, so that the draw rollers draw at precisely the lineal speed of the web. However, the diameter of the cutting cylinders 12, 13, and the speed of the conveyors and associated rotating elements in the sheeter, in accordance with the invention, remain unchanged. As a result, in cutting and transporting sheets of less than reference length, the cutting cylinders and associated high-speed conveyor 20 operate at a lineal speed which is relatively slightly higher than the speed of the incoming web. Since the cutting cylinders and knock-down arm are always driven at a 1:1 angular speed ratio with respect to the plate cylinders of the press, notwithstanding the fact that such plate cylinders may be reduced in diameter, the only effect of such reduction in diameter is that (a) the cutting cylinders operate at slightly above web speed and (b) the sheets on the high-speed conveyor have a correspondingly greater spacing, edge to edge. To accommodate the shorter sheet, and the resulting increase in spacing, all that is necessary is to rotate the handwheel 119 to advance the squaring and press down rollers 111, 112 "upstream" to engage the leading edge L of the sheet at an earlier point and to adjust the phase of the taper lock pulley 93 which drives the knock-down arm 90, as might be necessary, in order that the knock-down arm might engage the trailing end T of the sheet at the same time as, or just slightly after, the leading edge engages the squaring nip.

While it is convenient, in accommodating sheets of shorter than reference length, to employ different sets of draw rollers 10, 11 without making any other changes in the sheeter mechanism (except for the adjustments just mentioned) it is contemplated, and within the scope of the invention, to employ the same draw rollers 10, 11 for all sizes of sheet and to interpose, between the drive 18 and the draw rollers, a speed change mechanism 130 having an input connection 131 connected to the drive (see FIG. 3) and an output connection 132 connected to the draw rollers, the drive gear 19, under such conditions, being omitted. Consequently, the term "means for reducing the lineal speed of the draw rollers" includes not only a speed adjuster 130 but also provision for substitution of draw rollers having a diameter of a speed appropriate to the input speed of the web being received from the press.

Notwithstanding the versatility of the sheeter, it is highly integrated and compact. The drive elements are closely coupled to reduce play and the diverter is accommodated with a minimum length of gap. The knock-down arms 90, as will be seen in FIG. 2, are compactly fitted between the adjacent ribbons forming the auxiliary high speed induction belt, as are the squaring and pressing rollers 111, 112. Moreover, the adjusting means for the squaring rollers is integrated within the confines of the auxiliary belt. Because of the high speed reduction ratios which can be achieved by the present machine, resulting in high shingling density, input speeds may be accommodated appreciably in excess of more conventional sheeter mechanisms.

While elements 12, 13 have been referred to as a pair of cutting cylinders, it will be understood that it is not necessary to use two cooperating cutting cylinders and the invention may be practiced using a single cutting cylinder 12 having a blade which operates against a stationary blade, in which case the element 13 may be considered simply as an idler.

I claim as my invention:

1. In a sheeter for receiving a printed web from a printing press at high speed and for feeding sheets in shingled relation to a point of collection, the combination comprising a cutting cylinder, a sheeter drive for rotating the cutting cylinder in rotational synchronism with the plate cylinder of the press, a first conveyor belt coupled to the drive for transporting the cut sheets seriatim at high speed, a second conveyor belt having a length exceeding the length of the sheet and arranged at a slightly lower level than the first conveyor belt for receiving a sheet discharged from the latter at high speed, said second conveyor belt having an auxiliary loop of belt longitudinally arranged and spaced a short distance above it, the auxiliary loop of belt having a high speed driving connection with the drive for inducing prompt flow of sheets to the region above the second belt, the second conveyor belt having a plurality of transversely alined, widely spaced squaring rollers adjacent its downstream end, the squaring rollers bearing against the second conveyor belt and, with the second conveyor belt, serving to define a squaring nip for engaging the leading edge of the received sheet up the sheet on the second belt and to reduce its forward speed, the squaring rollers being mounted for idle rotation on a common shaft, means coupled to the drive for driving the second conveyor belt at a fraction of the speed of the first conveyor belt, a snubber in the form of a knock-down arm at the upstream end of the second conveyor belt, the knock-down arm being mounted for rotation in a vertical plane, driving means for the arm so phased with the arrival of the tail of the received sheet and so spaced with respect to the squaring rollers that the tail of the sheet is pressed by the end of the arm into engagement with the second conveyor belt thereby to decelerate the sheet to the speed of the second conveyor belt upon engagement of the leading edge of the sheet with the squaring rollers, and means for receiving sheets fed from the second conveyor belt.

2. The combination as claimed in claim 1 in which a roller is mounted on the end of the knock-down arm for engaging the sheet so that the sheet is free to adopt the speed of the second conveyor belt.

3. The combination as claimed in claim 1 in which the knock-down arm consists of at least two widely spaced arm elements secured to a common rotatable shaft and in which means are provided for changing the phase of the shaft so that the tail of the sheet is snubbed by the arm against the second conveyor belt immediately after engagement of the leading edge of the sheet with the nip of the squaring rollers.

4. The combination as claimed in claim 1 in which the shaft for the squaring rollers is received at its ends in movable mounting blocks, the blocks having means for simultaneous manual adjustment of longitudinal position to insure that the engaged sheet is engaged and squared simultaneously by all of the squaring rollers just prior to engagement of the tail thereof by the knock-down arm.

5. In a sheeter for receiving a printed web from a printing press and for feeding of sheets in shingled relation to a point of collection, the combination comprising driving means, a web of paper, a cutting cylinder coupled to the driving means for cutting the web into printed sheets of equal length, a first conveyor belt formed of a lower loop of belt, a first upper loop of belt, the belts being closely spaced face to face for embracing the sheets, means coupled to the driving means for driving the first conveyor belt at a high speed for transporting the sheets seriatim to a point of high speed discharge, a second conveyor belt formed of a lower loop of belt, a second upper loop of belt arranged face to face with respect to the second conveyor belt and offset both upwardly and upstream therefrom, a roller forming a nip with the upstream end of the second upper loop, the nip being spaced to define a gap with respect to the discharge end of the first conveyor belt, means coupled to the driving means for driving the upper loops at the same speed as the first conveyor belt so that a sheet traverses said gap and is fed into the nip without changing speed, the second conveyor belt having a plurality of transversely alined, widely spaced squaring rollers adjacent its downstream end, the squaring rollers bearing against the second conveyor belt and, with the second conveyor belt, serving to define a squaring nip for engaging the leading edge of the received sheet to square up the sheet on the second belt and to reduce its forward speed, the squaring rollers being mounted for idle rotation on a common shaft, means coupled to the driving means for driving the second conveyor belt at a fraction of the speed of the first conveyor belt so that the sheets passing through the nip are deposited on the second conveyor belt in shingled relation, a rotary snubber in the form of a knock-down arm mounted for rotation in a vertical plane at the upstream end of the second conveyor belt for pressing the sheet into engagement with the second conveyor belt to decelerate the sheet and to cause it to travel at the same speed as the second conveyor belt, means for driving the arm at a rotary speed synchronized with the cutting cylinder so that the arm acts upon the sheets on a one-to-one basis, and means for adjusting the phase of the arm so that the arm engages the tail of each sheet immediately upon engagement of the leading edge of the sheet with the squaring rollers to insure uniform shingling while avoiding any tendency toward buckling as the sheet is decelerated.

6. In a sheeter for feeding of sheets in shingled relation to a point of collection, the combination comprising a source of sheets fed seriatim, a first conveyor belt formed of a lower loop of belt, a first upper loop of belt pressing against the first conveyor belt, means for driving both of them at a high speed for transporting the sheets seriatim to a point of high speed discharge, a second conveyor belt formed of a lower loop of belt, a second upper loop of belt arranged face to face with respect to the second conveyor belt and spaced above it, a roller forming a high speed nip with the upstream end of the second upper loop, the nip being spaced to define a gap with respect to the discharge end of the first conveyor belt, means for driving the second upper loop at high speed so that a sheet traverses said gap and is fed into the nip without changing speed, means for driving the second conveyor belt at a fraction of the speed of the first conveyor belt so that the sheets fed from the nip are deposited on the second conveyor belt in shingled relation, a rotary snubber in the form of a knock-down arm mounted for rotation in a vertical plane at the upstream end of the second conveyor belt for pressing a sheet passing through the nip into engagement with the second conveyor belt to decelerate the sheet and to cause it to travel at the same speed as the second conveyor belt, means for driving the arm at a speed synchronized with the source so that the arm acts on the sheets on a one-to-one basis, and means for adjusting the phase of the arm so that the arm engages the tail of each sheet to insure uniform shingling while avoiding any tendency toward buckling as the sheets are decelerated, a diverter being positioned in the gap for diverting a specimen sheet in lieu of shingling thereof.

7. In a sheeter for receiving a printed web from a printing press and for feeding sheets in shingled relation to a point of collection, the combination comprising a pair of draw rollers for drawing web at the lineal speed of the press, a cutting cylinder adjacent the draw rollers, a sheeter drive for rotating the cutting cylinder in synchronism with the plate cylinder of the press, a first conveyor belt coupled to the drive for transporting the cut sheets seriatim to a point of high speed discharge, a second conveyor belt having a length exceeding the length of the sheet and arranged at a slightly lower level than the first conveyor belt for receiving a sheet discharged from the latter at a high speed, means including speed reduction for driving the second conveyor belt at a small fraction of the speed of the first conveyor belt so that sheets are deposited on the second conveyor belt in shingled relation, a plurality of identical squaring rollers widely spaced in transverse alinement in the downstream region of the second conveyor belt, the rollers being mounted for idle rotation in engagement with the second conveyor belt, a rotary snubber in the form of a unitary knock-down arm mounted for rotation in a vertical plane at the upstream end of the second conveyor belt for knocking down the tails of sheets, the arm being connected to the drive for driving at a rotational speed synchronized with the cutting cylinder, means for adjusting the phasing of the knock-down arm so that the arm engages the tails of successive sheets timed with the engagement of the leading edges of the sheets with the squaring rollers to decelerate the sheets to the speed of the second conveyor belt, means for receiving sheets fed from the second conveyor belt, and means for reducing the lineal speed of the draw rollers proportionately to the reduction of the lineal speed of the web upon use of a printing cylinder of smaller diameter in the press while maintaining angular synchronism of the cutting cylinder and knock-down arm with the rotary speed of the printing cylinder.

8. A sheeter for accepting a web of paper printed at high speed by the plate cylinder of a printing press and for forming individual sheets therefrom comprising, in combination, a pair of draw rollers for receiving the web from the press, a cutting cylinder, means for driving the draw rollers at a peripheral speed equal to web speed and for driving the cutting cylinder in unison with the plate cylinder of the press so that the cut sheets are phased with the printed impressions, a high speed conveyor belt for receiving sheets cut by the cutting cylinder, a slow speed conveyor belt having a length exceeding the length of a sheet and arranged at a slightly lower level than the high speed conveyor belt for receiving the sheets discharged from the latter in shingled relation, the slow speed conveyor belt having a set of laterally spaced squaring rollers adjacent its downstream end, the squaring rollers bearing against the slow speed conveyor belt and serving to define a squaring nip for engaging the leading edge of a received sheet to square up the sheet on the slow speed belt and to reduce its forward speed, the squaring rollers being mounted for idle rotation on a common shaft, a snubber in the form of a knock-down arm at the upstream end of the slow speed conveyor belt, the knock-down arm being mounted for rotation in a vertical plane, the arm being unitary and having driving means driving the arm in the direction of movement of an engaged sheet and so phased that the tail of the sheet is pressed by the end of the arm into engagement with the slow speed conveyor belt thereby to decelerate the tail of the sheet to the speed of the slow speed belt at the same time the leading edge of the sheet is engaged by the squaring rollers, and stationary means for receiving the shingled sheets fed from the slow speed belt.

* * * * *

UNITED STATES PATENT AND TRADEMARK OFFICE

CERTIFICATE OF CORRECTION

PATENT NO. : 3,994,221

DATED : November 30, 1976

INVENTOR(S) : F. John Littleton

It is certified that error appears in the above-identified patent and that said Letters Patent is hereby corrected as shown below:

In the claims:

Col. 7, line 38, after word "sheet" add -- to square --

Signed and Sealed this

*Fifteenth* Day of *May 1984*

[SEAL]

*Attest:*

GERALD J. MOSSINGHOFF

*Attesting Officer*

*Commissioner of Patents and Trademarks*

REEXAMINATION CERTIFICATE (195th)

United States Patent [19]

Littleton

[11] B1 3,994,221

[45] Certificate Issued May 22, 1984

[54] SHEETER FOR USE WITH PRINTING PRESS AND ADDING PROVISION FOR ARRESTING, SQUARING AND DIVERTING OF SHEET

[75] Inventor: F. John Littleton, Effingham, Ill.

[73] Assignee: World Color Press, Inc., Effingham, Ill.

Reexamination Request:
No. 90/000,426, Jul. 28, 1983

Reexamination Certificate for:

| | |
|---|---|
| Patent No.: | **3,994,221** |
| Issued: | **Nov. 30, 1976** |
| Appl. No.: | **618,813** |
| Filed: | **Oct. 2, 1975** |

[51] Int. Cl.[3] ..... B41F 13/56
[52] U.S. Cl. ..... 101/227; 271/202
[58] Field of Search ..... 271/202, 227, 182, 302

[56] References Cited

U.S. PATENT DOCUMENTS

| | | | |
|---|---|---|---|
| 2,261,972 | 11/1941 | Matthews | 271/202 |
| 2,819,079 | 1/1958 | Beaulieu | 271/202 |
| 3,096,978 | 7/1963 | Jendrusch | 271/182 |
| 3,178,174 | 4/1965 | Schneider | 271/202 |
| 3,315,956 | 4/1967 | Lyman | 271/202 |
| 3,502,321 | 3/1970 | McWhorter | 271/202 |
| 3,820,775 | 6/1974 | Miller | 271/302 |

FOREIGN PATENT DOCUMENTS 1158844 7/1969 United Kingdom .

*Primary Examiner*—William Pieprz

[57] ABSTRACT

A sheeter for feeding sheets in shingled relation to a point of collection including a source of sheets, a first conveyor belt and a second conveyor belt operating at substantially reduced speed so that the sheets are collected thereon in shingled relation. For snubbing the successive sheets so that they are decelerated and uniformly spaced on the second conveyor belt, a snubber is provided in the form of a knock-down roller arm rotating in a vertical plane at the upstream end of the second conveyor belt and so spaced therefrom as to press a sheet into engagement with the second conveyor belt, the arm being driven at a rotary speed which is synchronized with the source, with means being provided for adjusting the phase of the arm with respect to the source so that the arm engages the tail of each successive sheet. In the preferred form of the invention the conveyor belts are separated to form a gap occupied by a diverter, and a high speed nip is provided at the downstream end of the gap so that a sheet traverses the gap and is fed into the nip without changing its speed. For squaring up each sheet passing through the high-speed nip, a pair of squaring and press down rollers are provided at the downstream end of the second conveyor belt with means for adjusting the longitudinal position of the rollers so that they are engaged by the leading edge of the sheet just prior to engagement of the tail of the sheet by the knock-down arm thus insuring precise shingling and freedom from buckling of individual sheets. Infinetely variable cutoff is provided.

REEXAMINATION CERTIFICATE ISSUED UNDER 35 U.S.C. 307.

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–6 and 8 is confirmed.

Claim 7 is determined to be patentable as amended:

7. In a sheeter for receiving a printed web from a printing press and for feeding sheets in shingled relation to a point of collection, the combination comprising a pair of draw rollers for drawing web at the lineal speed of the press, a cutting cyclinder adjacent the draw rollers, a sheeter drive for rotating the cutting cylinder in synchronism with the plate cylinder of the press, a first conveyor belt coupled to the drive for transporting the cut sheets seriatim to a point of high speed discharge, a second conveyor belt having a length exceeding the length of the sheet and arranged at a slightly lower level than the first conveyor belt for receiving a sheet discharged from the latter at a high speed, means including speed reduction for driving the second conveyor belt at a small fraction of the speed of the first conveyor belt in shingled relation, a plurality of identical squaring rollers widely spaced in transverse alinement in the downstream region of the second conveyor belt, the rollers being mounted for idle rotation in engagement with the second conveyor belt, a rotary snubber in the form of a unitary knock-down arm mounted for rotation in a vertical plane at the upstream end of the second conveyor belt for knocking down [the tails of sheets] *and pressing the tail of each passing sheet into engagement with said second conveyor belt*, the arm being connected to the drive for driving at a rotational speed synchronized with the cutting cylinder, means for adjusting the phasing of the knock-down arm so that the arm engages the tails of successive sheets timed with the engagement of the leading edges of the sheets with the squaring rollers to decelerate the sheets to the speed of the second conveyor belt, means for receiving sheets fed from the second conveyor belt, and means for reducing the lineal speed of the draw rollers proportionately to the reduction of the lineal speed of the web upon use of a printing cylinder of smaller diameter in the press while maintaining angular synchronism of the cutting cylinder and knock-down arm with the rotary speed of the printing cylinder.

* * * * *